US011576487B2

(12) United States Patent
Irgang

(10) Patent No.: US 11,576,487 B2
(45) Date of Patent: Feb. 14, 2023

(54) SECURING DEVICE FOR DETACHABLY SECURING A FRONT PANEL TO A DRAWER

(71) Applicant: Julius Blum GmbH, Hoechst (AT)

(72) Inventor: Markus Irgang, Altach (AT)

(73) Assignee: JULIUS BLUM GMBH, Hoechst (AT)

( * ) Notice: Subject to any disclaimer, the term of this patent is extended or adjusted under 35 U.S.C. 154(b) by 21 days.

(21) Appl. No.: 17/209,939

(22) Filed: Mar. 23, 2021

(65) Prior Publication Data

US 2021/0204692 A1 Jul. 8, 2021

Related U.S. Application Data

(63) Continuation of application No. PCT/AT2019/060302, filed on Sep. 13, 2019.

(30) Foreign Application Priority Data

Oct. 5, 2018 (AT) ..... A 50862/2018

(51) Int. Cl.
*A47B 88/95* (2017.01)

(52) U.S. Cl.
CPC ..... *A47B 88/95* (2017.01); *A47B 2088/954* (2017.01)

(58) Field of Classification Search
CPC . A47B 88/95; A47B 2088/954; A47B 88/956; A47B 2088/951
See application file for complete search history.

(56) References Cited

U.S. PATENT DOCUMENTS

| | | | | |
|---|---|---|---|---|
| 7,540,577 | B2 | 6/2009 | Netzer | |
| 8,328,299 | B2 | 12/2012 | Hashemi et al. | |
| 8,727,461 | B2 | 5/2014 | Holzapfel et al. | |
| 8,801,123 | B2 | 8/2014 | Kueng | |
| 9,033,436 | B2 | 5/2015 | Holzapfel et al. | |
| 9,204,721 | B2 | 12/2015 | Gasser et al. | |
| 9,464,652 | B2 | 10/2016 | Holzapfel et al. | |
| 9,801,468 | B2 | 10/2017 | Hashemi et al. | |
| 10,113,788 | B2 | 10/2018 | Zhang et al. | |
| 10,448,738 | B2 | 10/2019 | Hashemi et al. | |
| 10,702,063 | B2 * | 7/2020 | Rocklage | A47B 88/956 |
| 10,966,523 | B2 | 4/2021 | Kampl et al. | |
| 11,071,381 | B2 * | 7/2021 | Held | A47B 88/941 |
| 11,197,546 | B2 * | 12/2021 | Meusburger | A47B 88/95 |
| 11,202,505 | B2 * | 12/2021 | Kampl | A47B 88/944 |
| 11,304,523 | B2 * | 4/2022 | Kampl | A47B 88/944 |
| 2003/0075541 | A1 | 4/2003 | Bartasevich, Jr. et al. | |

(Continued)

FOREIGN PATENT DOCUMENTS

| | | |
|---|---|---|
| AT | 511066 | 9/2012 |
| AT | 512616 | 5/2017 |

(Continued)

*Primary Examiner* — Hanh V Tran
(74) *Attorney, Agent, or Firm* — Wenderoth, Lind & Ponack, L.L.P.

(57) ABSTRACT

A fastening device for releasably fixing a front panel to a drawer, in particular to a drawer sidewall, includes at least two connecting elements configured to be mounted to the front panel and at least two locking devices associated to the drawer for, preferably releasably, locking the two connecting elements. At least one cable is provided to connect the at least two locking devices to one another.

23 Claims, 6 Drawing Sheets

(56) References Cited

U.S. PATENT DOCUMENTS

| | | | | |
|---|---|---|---|---|
| 2007/0228906 | A1 | 10/2007 | Netzer | |
| 2011/0069914 | A1 | 3/2011 | Hashemi et al. | |
| 2011/0163647 | A1 | 7/2011 | Hartl | |
| 2012/0286116 | A1* | 11/2012 | Gasser | A47B 88/956 248/221.11 |
| 2013/0069514 | A1 | 3/2013 | Hashemi et al. | |
| 2013/0181588 | A1 | 7/2013 | Hashemi et al. | |
| 2013/0249370 | A1* | 9/2013 | Kueng | A47B 88/95 312/348.4 |
| 2013/0257252 | A1* | 10/2013 | Holzapfel | A47B 88/956 312/348.4 |
| 2014/0072366 | A1* | 3/2014 | Holzapfel | A47B 88/95 403/326 |
| 2014/0077677 | A1 | 3/2014 | Holzapfel et al. | |
| 2014/0077678 | A1* | 3/2014 | Holzapfel | A47B 88/95 312/348.4 |
| 2014/0184047 | A1* | 7/2014 | Grimm | A47B 88/95 312/319.1 |
| 2014/0252936 | A1* | 9/2014 | Holzapfel | A47B 88/956 312/348.4 |
| 2014/0346941 | A1 | 11/2014 | Gasser et al. | |
| 2017/0135473 | A1* | 5/2017 | Chen | A47B 88/483 |
| 2017/0261254 | A1 | 9/2017 | Zhang et al. | |
| 2018/0000242 | A1* | 1/2018 | Hoffmann | A47B 88/956 |
| 2018/0177294 | A1 | 6/2018 | Hashemi et al. | |
| 2019/0343279 | A1 | 11/2019 | Kampl et al. | |
| 2020/0260868 | A1 | 8/2020 | Meusburger et al. | |

FOREIGN PATENT DOCUMENTS

| | | | | |
|---|---|---|---|---|
| AT | 520427 | | 4/2019 | |
| AT | 520427 | A4 * | 4/2019 | A47B 88/95 |
| CN | 101511227 | | 8/2009 | |
| CN | 102159117 | | 8/2011 | |
| CN | 102178406 | | 9/2011 | |
| CN | 102293535 | | 12/2011 | |
| CN | 103747704 | | 9/2015 | |
| CN | 106333527 | | 1/2017 | |
| CN | 104398027 | | 4/2017 | |
| DE | 10 2015 122 192 | | 6/2017 | |
| DE | 102017121385 | A1 * | 3/2019 | A47B 88/956 |
| EP | 2 424 404 | | 9/2016 | |
| EP | 3167760 | A1 * | 5/2017 | A47B 88/0051 |
| JP | 2014-503237 | | 2/2014 | |
| JP | 2014-515278 | | 6/2014 | |
| JP | 2014-517755 | | 7/2014 | |
| TW | 201835458 | | 10/2018 | |
| WO | 03/033365 | | 4/2003 | |
| WO | 2012/068599 | | 5/2012 | |
| WO | 2012/068602 | | 5/2012 | |
| WO | 2012/171047 | | 12/2012 | |
| WO | WO-2012171047 | A1 * | 12/2012 | A47B 88/95 |

* cited by examiner

SECURING DEVICE FOR DETACHABLY SECURING A FRONT PANEL TO A DRAWER

BACKGROUND OF THE INVENTION

The invention relates to a fastening device for releasably fixing a front panel to a drawer, in particular to a drawer sidewall. The fastening device comprises at least two connecting elements configured to be mounted to the front panel and at least two locking devices associated with the drawer for, preferably releasably, locking the at least two connecting elements.

Moreover, the invention relates to an arrangement comprising a drawer, a front panel, and at least one of such a fastening device for releasably fixing the front panel to the drawer. Moreover, the invention concerns an item of furniture comprising at least one of such an arrangement.

Fastening devices for releasably fixing a front panel to a drawer are already known in the prior art.

The AT 50932/2017 (AT 520427 A4) reference to the present applicant discloses a fastening device for releasably fixing a front panel to a drawer, in particular to a drawer sidewall. In one embodiment for high front panels, two locking devices are provided. The movements of the two locking devices are thereby coupled by a linkage assembly. Accordingly, the locking devices can be simultaneously locked or unlocked.

Such a type of a movement-coupling of the locking devices, in particular with an increasing height of the front panel, includes a plurality of drawbacks.

Due to the required deflections of the linkage assembly, a large number of components for the coupling is required on the one hand. On the other hand, such a linkage assembly requires a relatively large installation space.

Moreover, a force-transmission between the locking devices is only provided when a pressure force is applied.

A further drawback is the fact that upon an unlocking operation, a relatively large actuating force is required for actuating the unlocking device, because an engagement location of the linkage assembly is arranged adjacent to a pivot point of the unlocking device.

When the locking devices are coupled by a linkage assembly, it is further necessary that an own associated linkage assembly has to be provided for each constructional height of the front panel.

SUMMARY OF THE INVENTION

The object of the present invention is to eliminate the drawbacks according to the prior art and to propose a fastening device which is improved over the prior art. A further object is to propose an arrangement comprising such an improved fastening device, and to propose an item of furniture comprising at least one of such an arrangement.

In relation to the fastening device, it is thus provided that at least one cable is provided, the at least one cable connecting the at least two locking devices to one another.

By the coupling of the at least two locking devices with the aid of a cable, a component-saving and a space-saving design of the fastening device can be made possible, because there is no need for a complex linkage assembly having deflections.

It is further possible that a transmission of force between the at least two locking devices can be provided by applying a pulling force.

Moreover, a distance of an engagement location of the cable in relation to the pivot point of the unlocking device can be chosen such that an actuating force for actuating the unlocking device can be reduced.

Moreover, when the constructional height of a front panel is altered, only the cable has to be adapted in its length.

According to a preferred embodiment of the invention, at least one of the at least two locking devices includes at least one pivot lever having a straight portion The at least one cable is connected to the at least one pivot lever such that the at least one cable, at least over a region, encloses an angle of between 70° and 100°, preferably of between 75° and 90°, to the straight portion of the at least one pivot lever.

It has further been proven to be advantageous that at least one of the at least two locking devices includes at least one pivot lever configured to be moved along a trajectory between a first position and a second position, and the at least one cable, via a cable end, is fixed to the pivot lever such that the cable end is aligned substantially parallel to the trajectory.

Thereby, it can be ensured that an optimal force transmission between the pivot lever and the cable can be provided.

According to a further aspect of the invention, at least one deflection device is provided for guiding the at least one cable. It is preferable that the at least one deflection device includes at least one deflection roller. This has the advantage that the cable can be optimally guided within the fastening device.

It has particularly been proven to be advantageous that at least one force storage member is provided, the at least one force storage member pressurizing a first of the at least two locking devices with a force for holding the first locking device in a locking position in which one of the at least two connecting elements can be locked. In that way, a reliable locking of the first locking device can be ensured.

Preferably, the at least one force storage member pressurizes the second of the at least two locking devices, via the at least one cable, with a force for holding the second locking device in a release position in which one of the at least two connecting elements can be unlocked.

According to a further aspect of the invention, at least one bearing device is provided for pivotally supporting the at least one cable on at least one of the at least two locking devices. This contributes for a durability of the cable, because no notch effect occurs on the cable by virtue of the bearing device.

In addition, at least one actuating plate can be provided for movably, preferably pivotally, supporting the at least two locking devices. It is preferable that at least one mounting plate is provided for mounting the fastening device to the drawer, and the at least one actuating plate is adjustably supported relative to the at least one mounting plate. In that way, the position of the front panel relative to the drawer can be adjusted.

It has particularly been proven to be advantageous that at least one release device is provided for moving the at least two locking devices, preferably simultaneously, from a locking position in which the at least one locking elements can be locked, into a release position in which the at least two connecting elements can be released. It is preferable that the at least one release device includes at least one tool-receiving device. In that way, a repeated locking and unlocking operation can be provided.

It can also be provided that at least one of the at least two locking devices includes at least one catch device configured to receive and to automatically pull at least one of the at least two connecting elements towards the drawer upon introducing. This facilitates a fixing of the front panel to the drawer.

According to a further embodiment of the invention, at least one of the at least two locking devices includes at least one first lever and a second lever coupled therewith.

Preferably, at least one of the at least two locking devices includes at least one inclined surface for urging the locking device at least over a region upon introducing one of the at least two connecting elements, preferably against a force pressurization of a force storage member. This facilitates the fixing of the front panel to a drawer.

According to a further aspect of the invention, the at least two connecting elements can be formed on at least two furniture fittings configured independently from one another, or are formed on a common furniture fitting.

As mentioned in the introductory part, protection is also sought for an arrangement comprising a drawer, a front panel and at least one fastening device according to the invention for releasably fixing the front panel to the drawer. It is preferable that the drawer includes at least one drawer sidewall configured to be hollow at least over a region, and that the at least one fastening device is arranged, for the most part, within the at least one drawer sidewall. Protection is also sought for an item of furniture comprising at least one of such an arrangement.

BRIEF DESCRIPTION OF DRAWINGS

Further details and advantages of the invention will be explained with the aid of the description of figures and with reference to the drawings, in which.

DETAILED DESCRIPTION OF INVENTION

Figure 1B:
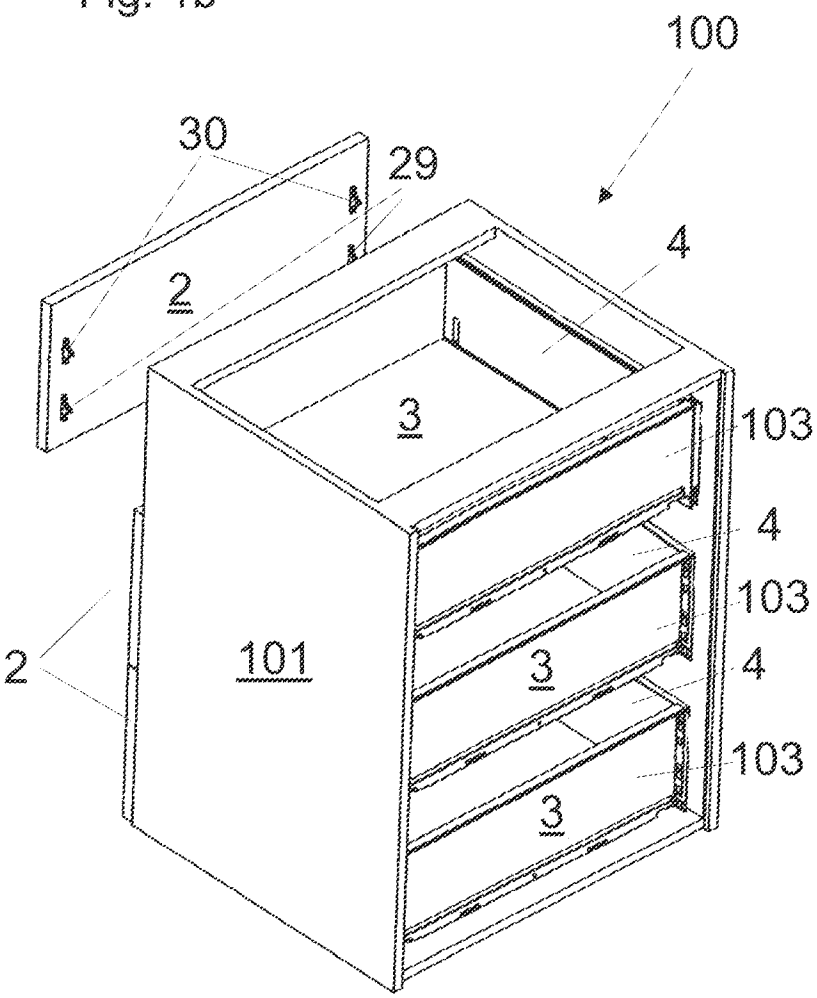
FIG. 1*b* shows an item of furniture comprising an arrangement according to the invention in a perspective view from the rear.
Figure 1A:
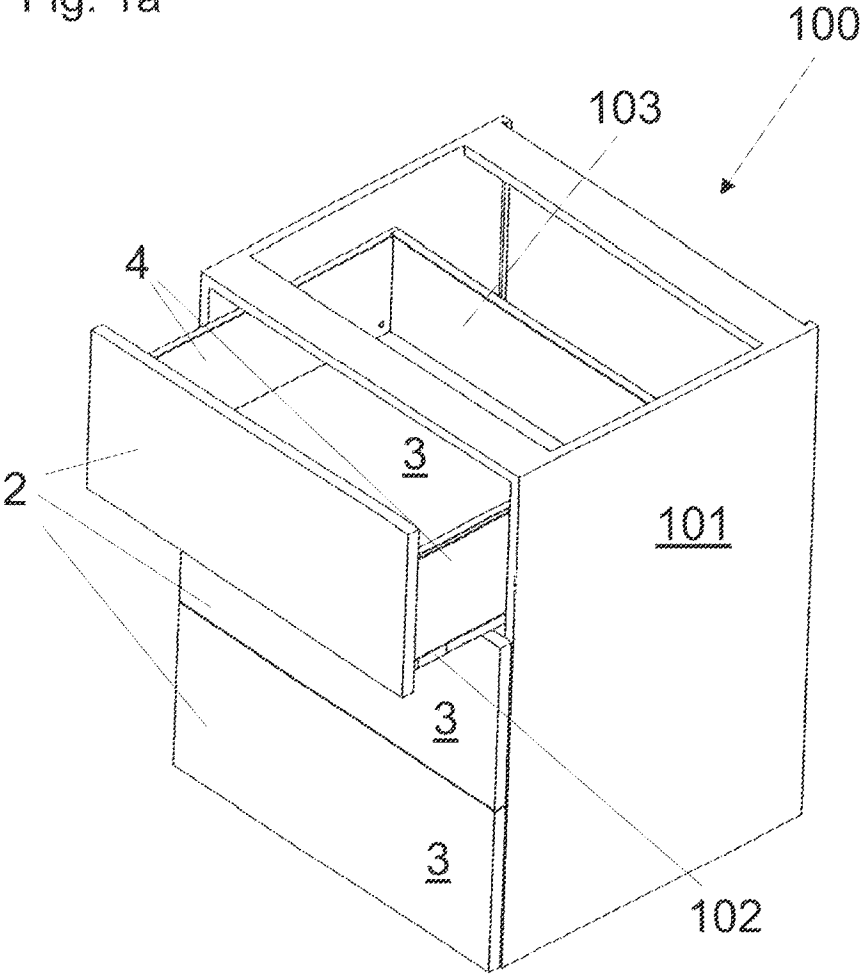
FIG. 1*a* shows an item of furniture comprising an arrangement according to the invention in a perspective view from the front.

FIG. 1*a* shows a perspective view of an item of furniture 100 from the front. The item of furniture 100 includes three drawers 3 in a furniture carcass 101. The drawers 3 are movably supported on a drawer pull-out guide 102 in the furniture carcass 101. Each of the drawers 3 includes two drawer sidewalls 4, a front panel 2 and a drawer rear wall 103. The front panel 2 is fixed to the two drawer sidewalls 4 of the drawer 3 via the fastening devices 1 which are not shown here (see FIG. 2).

FIG. 1*b* shows a perspective view of an item of furniture 100 from the rear. The item of furniture 100, in turn, includes three drawers 3, as just described in connection with FIG. 1*a*. The front panel 2 has not yet been mounted to the uppermost drawer 3. For this reason, four furniture fittings 29, 30 can be seen. The furniture fittings 29, 30 include connecting elements 5 for establishing a connection between the fastening devices 1 and the drawer sidewalls 4.

Figure 2:
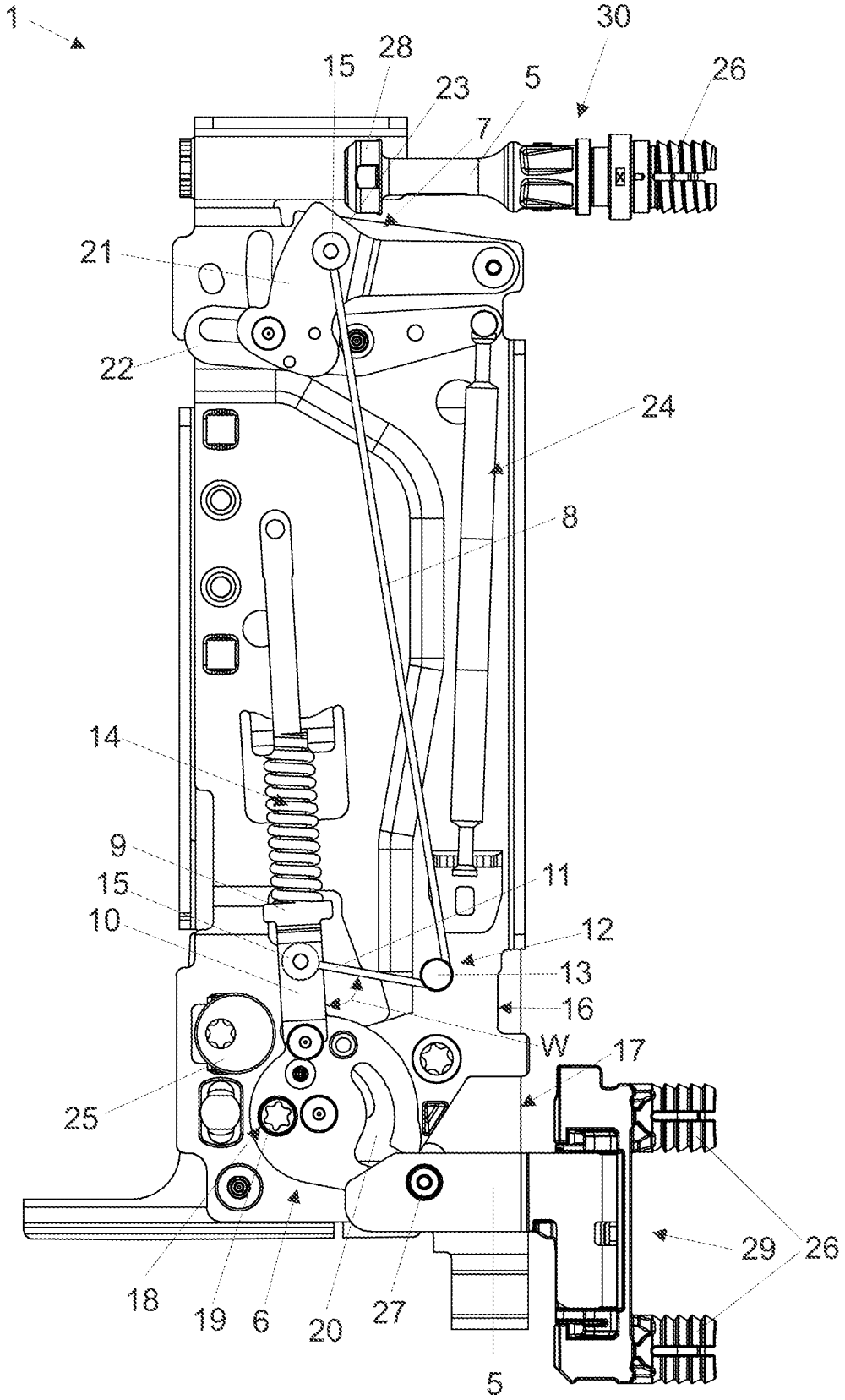
FIG. 2 shows a fastening device according to the invention with the connecting elements in a release position.

FIG. 2 shows an embodiment of a fastening device 1 for releasably fixing a front panel 2 to a drawer 3, the fastening device 1 being in a release position. Thereby, two locking devices 6, 7 can be seen, the two locking devices 6, 7 being connected to one another by a cable 8.

The first locking device 6 thereby includes a release device 18 comprising a tool-receiving device 19.

Moreover, the first locking device 6 can include a catch device 20, as already known from the prior art.

Moreover, a pivot lever 9 can be seen, the pivot lever 9 having a straight portion 10. The pivot lever 9 further serves as a guide for a first force storage member 14 configured as a compression spring. However, the first force storage member 14 may also be configured as a gas pressure spring or the like.

The second locking device 7 includes a first lever 21 and a second lever 22 coupled to the first lever 21.

Moreover, the second locking device 7 includes an inclined surface 23 arranged on the first lever 21.

Moreover, a second force storage member 24 in the form of a tension spring can be seen. Likewise, this second force storage member 24 can be configured as a gas pressure spring or the like.

It can further be seen that the cable 8 is pivotally supported on the locking devices 6, 7 on two bearing devices 15. Further, the cable 8 is deflected via a deflection device 12 comprising a deflection roller 13. The cable end 11 encloses an angle (W) to the straight portion 10 of the pivot lever 9.

FIG. 2 further shows a mounting plate 17 for mounting the fastening device 1 to the drawer 3. An actuating plate 16 is arranged on the mounting plate 17. This actuating plate 16 is configured to be adjusted relative to the mounting plate 17 by an adjustment device 25.

In this embodiment, the locking devices 6, 7 are movably arranged on the actuating plate 16.

Furthermore, the furniture fittings 29, 30 can be seen. The furniture fittings 29, 30 include fastening elements 26 for fixing the furniture fittings 29, 30 to the front panel 2, a connecting element 5 and a transverse pin 27 in the case of the lower furniture fitting 29, or a pin 28 in the case of the upper furniture fitting 30.

The furniture fittings 29, 30 can also be configured as a single furniture fitting having at least two connecting elements 5, at least two fastening elements 26, at least one transverse pin 27 and at least one pin 28.

The functionality of the fastening device 1 will now be explained with the aid of FIGS. 2, 3 and FIGS. 4, 5, respectively.

FIG. 2 shows the fastening device 1 immediately before introducing the connecting elements 5 into the fastening device 1. The locking devices 6, 7 are located in a release position in which the connecting elements 5 are freely movably in relation to the locking devices 6, 7.

The first locking device 6 is held in an over-dead-center position with the aid of the force storage member 14. The second locking device 7 is held in the release position by the first locking device 6 with the aid of the cable 8 against the force of the second force storage member 24.

The catch device 20 is located in a ready position.

When the front panel 2, and thus the connecting elements 5, is moved in a direction towards the drawer 3, the transverse pin 27 abuts against the first locking device 6, the pin 28 against the first lever 21, and the inclined surface 23 against the second locking device 7. Thereby, the catch device 20 receives the transverse pin 27.

The catch device 20, in a manner known per se, automatically pulls the transverse pin 27 and thus the connecting element 5 of the furniture fitting 29 towards the drawer 3.

When the connecting element 5 of the furniture fitting 29 is introduced, the first locking device 6 is moved from the over-dead-center position beyond a dead-center, whereby the first locking device 6 is moved by the first force storage member 14 into a locking position. Because the cable 8 does no longer operate against the second force storage member 24, the second locking device 7 is moved by the second force storage member 24 into the locking position.

It is possible that the locking devices 6, 7 are already locked and, on the contrary, the connecting element 5 of the furniture fitting 30 is not yet introduced into the second locking device 7. For this case, the first lever 21 of the second locking device 7 can be urged by the connecting element 5 of the furniture fitting 30 via the inclined surface 23, and the connecting element 5 of the furniture fitting 30 can thus be entirely introduced into the second locking device 7 and locked.

Figure 3:
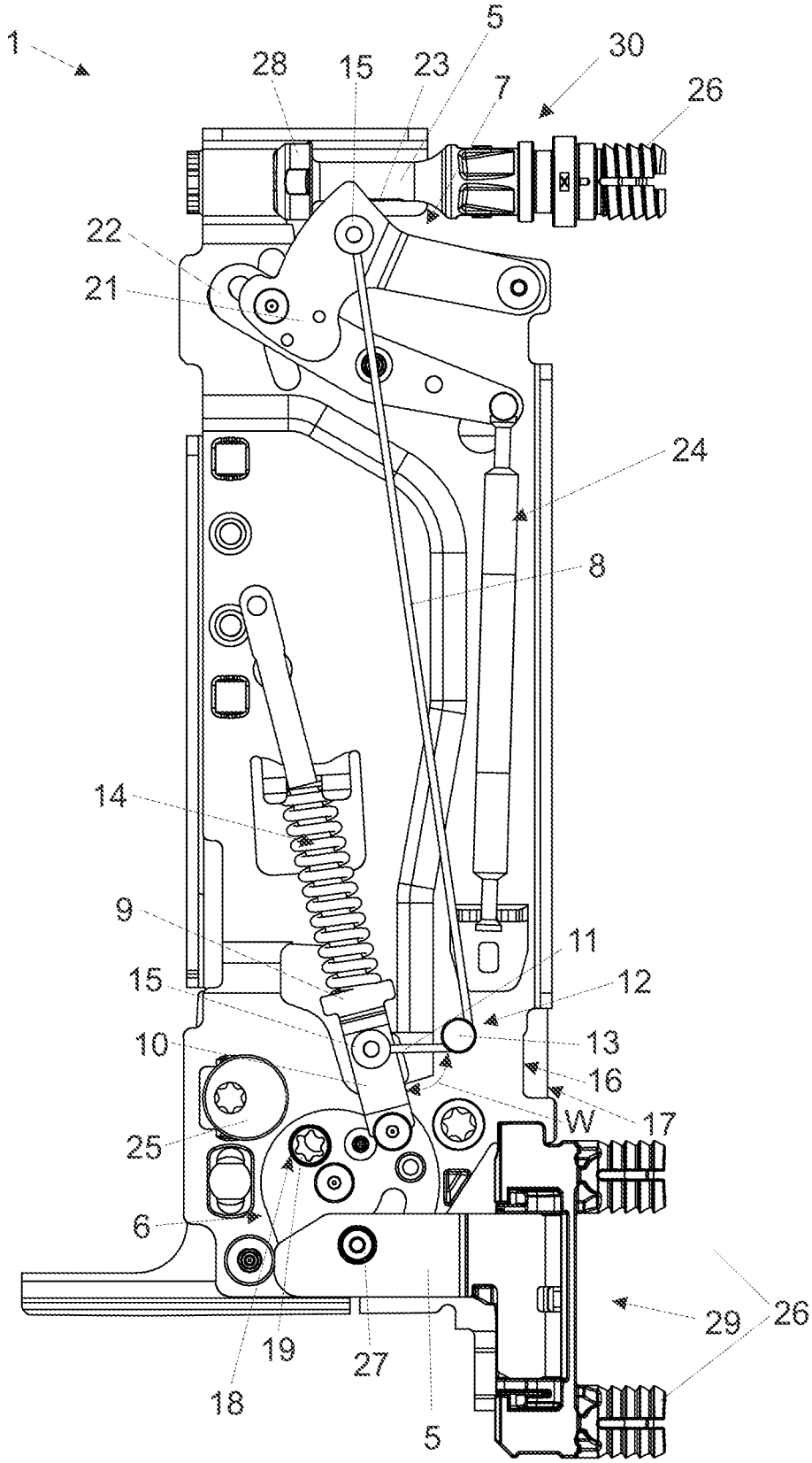
FIG. 3 shows a fastening device according to the invention with the connecting elements in a locking position.

FIG. 3 shows the fastening device 1 in the locking position. It can be seen that the locking devices 6, 7 have received and locked the connecting elements 5.

If the front panel 2 shall again be released from the drawer 3, the release device 18 can be actuated via the tool-receiving device 19 with the aid of a tool, for example by a screwdriver.

By an actuation of the release device 18, the first locking device 6 is moved beyond the dead-center into the over-dead-center position. The first force storage member 14 holds the first locking device 6 in the over-dead-center and release position. By the cable 8, the second locking device 7 is also simultaneously moved into the release position against the force pressurization of the second force storage member 24.

The connecting elements 5 are therefore again freely movable in relation to the locking devices 6, 7. The front panel 2 can thus be separated from the drawer 3.

Figure 4:
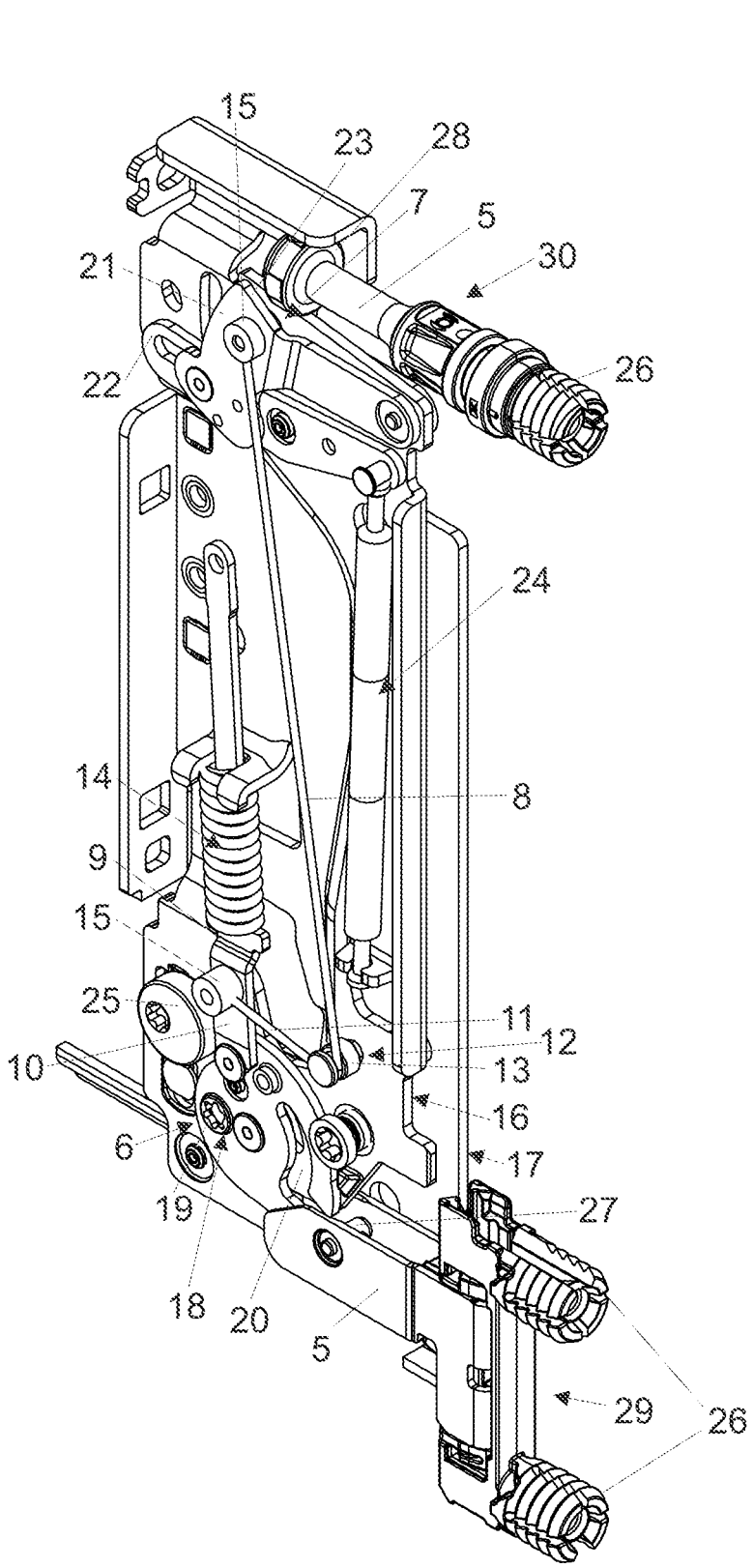
FIG. 4 is a perspective view of a fastening device according to the invention with the connecting elements in a release position.
Figure 5:
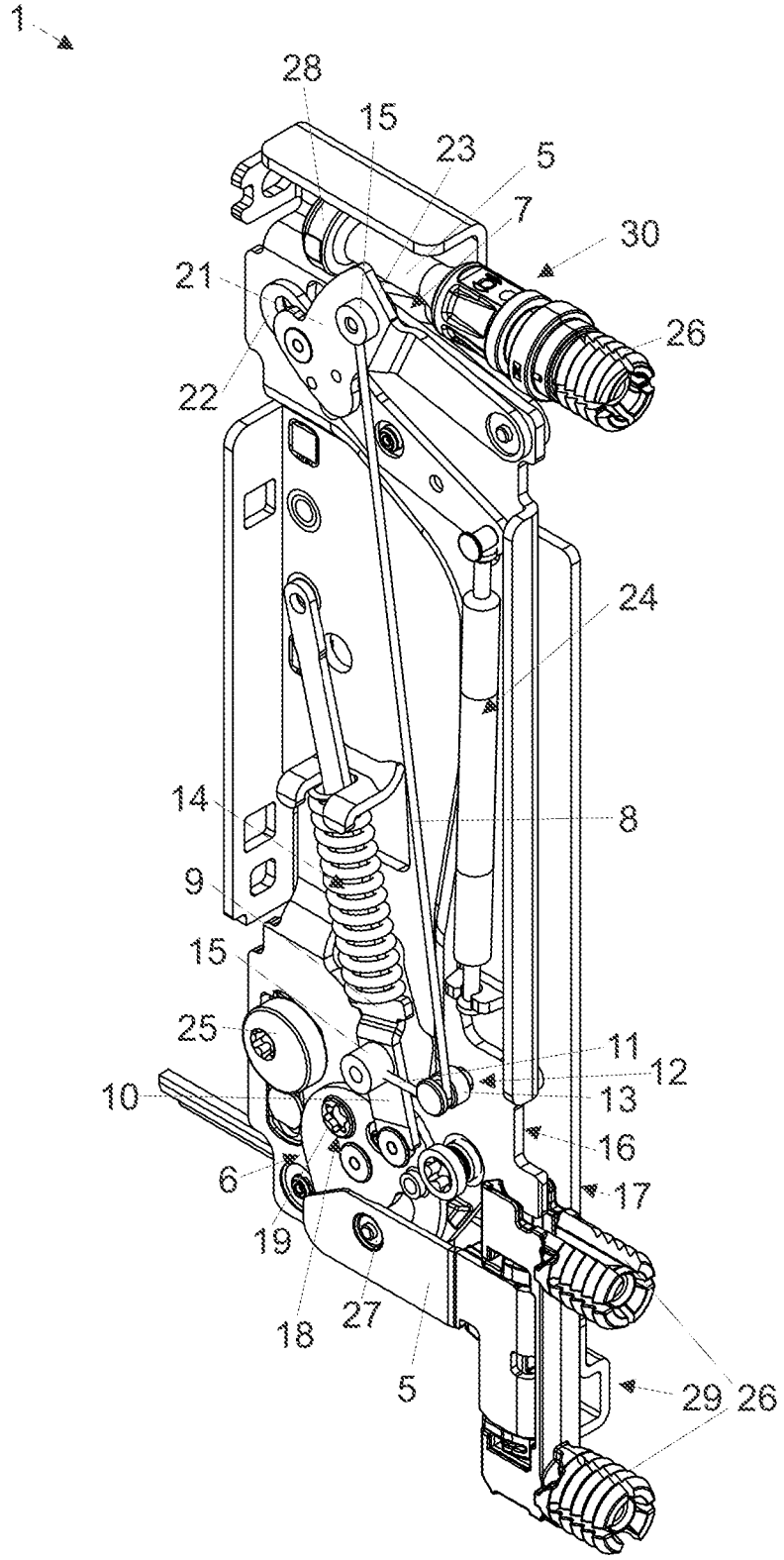
FIG. 5 is a perspective view of a fastening device according to the invention with the connecting elements in a locking position.

FIGS. 4 and 5, respectively, again show the actuating device 1 in the release- and locking position, respectively. However, for a better understanding of the invention, in a perspective view.

Figure 6:
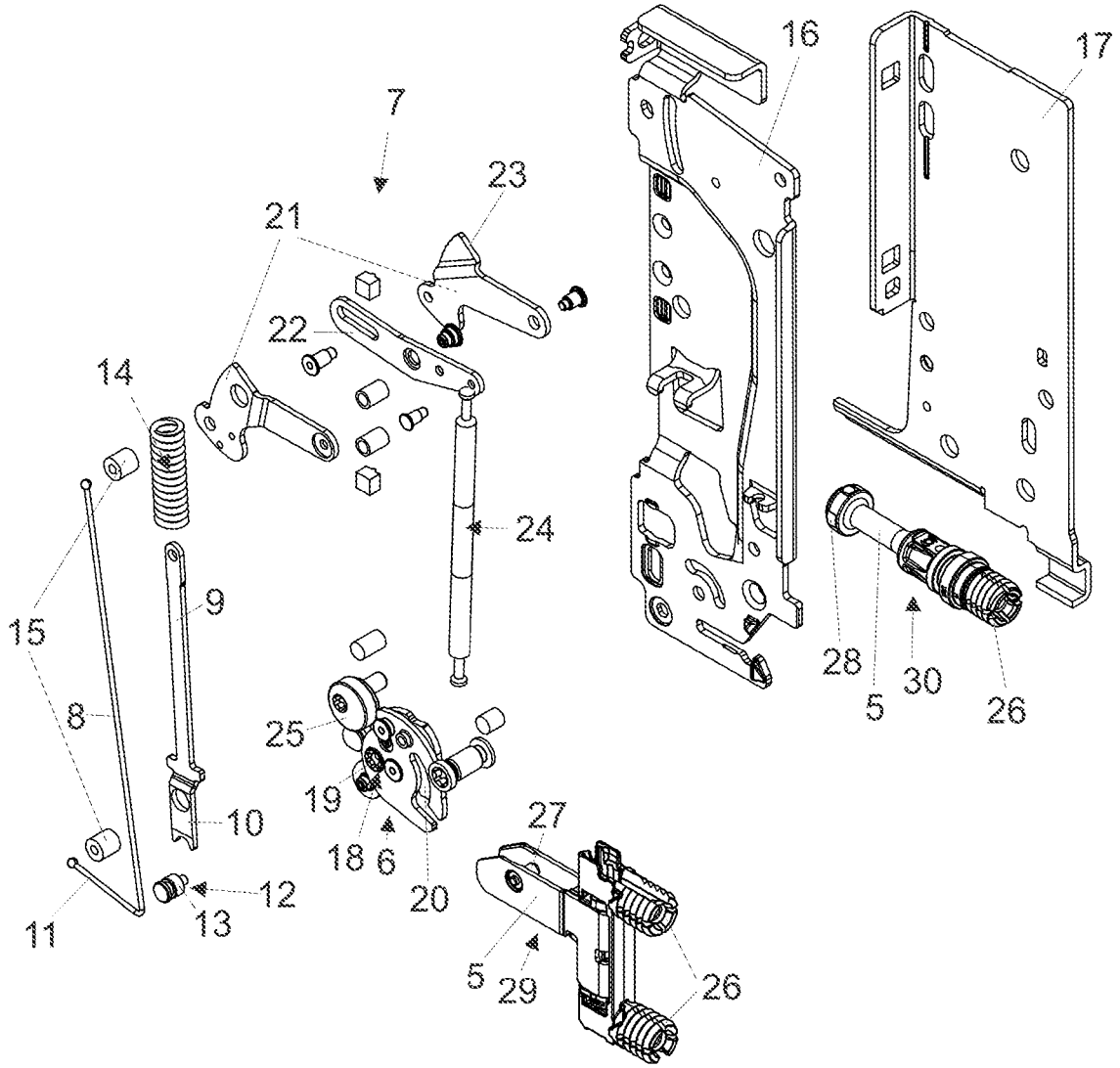
FIG. 6 shows a fastening device according to the invention with the connecting elements in an exploded view.

FIG. 6 shows the fastening device 1 in an exploded view. The assembly of the fastening device 1 is, therefore, shown in greater detail.

The invention claimed is:

1. A fastening device for releasably fixing a front panel to a drawer, the fastening device comprising:

at least two connecting elements configured to be mounted to the front panel;

at least two locking devices associated to the drawer for locking the two connecting elements; and a cable connecting the at least two locking devices to one another.

2. The fastening device according to claim 1, wherein at least one of the at least two locking devices includes a pivot lever having a straight portion, the cable being connected to the pivot lever such that the cable, at least over a region, encloses an angle of between 70° and 100° to the straight portion of the pivot lever.

3. The fastening device according to claim 1, wherein at least one of the at least two locking devices includes a pivot lever configured to be moved along a trajectory between a first position and a second position, wherein the cable is fixed to the pivot lever via a cable end such that the cable end is aligned substantially parallel to the trajectory.

4. The fastening device according to claim 1, further comprising a deflection device for guiding the cable.

5. The fastening device according to claim 1, further comprising a force storage member for pressurizing a first of the at least two locking devices with a force for holding a first one of the at least two locking devices in a locking position in which one of the at least two connecting elements can be locked.

6. The fastening device according to claim 5, wherein the force storage member pressurizes a second one of the at least two locking devices via the cable with a force for holding the second one of the at least two locking devices in a release position in which one of the at least two connecting elements can be released.

7. The fastening device according to claim 1, further comprising a bearing device for pivotally supporting the cable on at least one of the at least two locking devices.

8. The fastening device according to claim 1, further comprising at least two force storage members, each of the at least two force storage members being configured to pressurize one of the at least two locking devices with a force for holding a second one of the at least two locking devices in a locking position in which one of the at least two connecting elements can be locked.

9. The fastening device according to claim 1, further comprising an actuating plate, the at least two locking devices being movably supported on the actuating plate.

10. The fastening device according to claim 1, further comprising a release device for moving the at least two locking devices from a locking position, in which the at least two connecting elements can be locked, into a release position, in which the at least two connecting elements can be released.

11. The fastening device according to claim 1, wherein at least one of the at least two locking devices includes a catch device configured to receive and to automatically pull at least one of the at least two connecting elements towards the drawer upon introduction.

12. The fastening device according to claim 1, wherein at least one of the at least two locking devices includes a first lever and a second lever coupled therewith.

13. The fastening device according to claim 1, wherein at least one of the at least two locking devices includes an inclined surface for at least partially displacing the locking device upon introduction of one of the at least two connecting elements.

14. The fastening device according to claim 1, wherein the at least two connecting elements are formed on at least two furniture fittings configured independently from one another, or are formed on a common furniture fitting.

15. An arrangement comprising a drawer, a front panel, and the fastening device according to claim 1 for releasably fixing the front panel to the drawer.

16. An item of furniture comprising a furniture carcass and the arrangement according to claim 15.

17. The fastening device according to claim 1, wherein the at least two locking devices are configured to releasably lock the two connecting elements.

18. The fastening device according to claim 2, wherein the cable is connected to the pivot lever such that the cable, at least over a region, encloses an angle of between 75° and 90°, to the straight portion of the pivot lever.

19. The fastening device according to claim 4, wherein the deflection device includes a deflection roller.

20. The fastening device according to claim 9, wherein the at least two locking devices are pivotally supported on the actuating plate, the fastening device further comprising a mounting plate for mounting the fastening device to the drawer, and the actuating plate is adjustably supported relative to the mounting plate.

21. The fastening device according to claim 10, wherein the release device is configured to simultaneously move the at least two locking devices from the locking position into the release position, and the release device includes a tool-receiving device.

22. The fastening device according to claim 13, wherein the inclined surface is configured to displace the locking device upon introduction of one of the at least two connecting elements against a force pressurization of a force storage member.

23. The fastening device according to claim 15, wherein the drawer includes a drawer sidewall configured to be at least partially hollow, and the fastening device is arranged at least partially within the drawer sidewall.

* * * * *